US008096070B2

(12) United States Patent
Markoff

(10) Patent No.: US 8,096,070 B2
(45) Date of Patent: Jan. 17, 2012

(54) TRUCK AND WALL BANNER HOLDING FRAME

(76) Inventor: Jay Fredrics Markoff, Spring Valley, CA (US)

( * ) Notice: Subject to any disclaimer, the term of this patent is extended or adjusted under 35 U.S.C. 154(b) by 121 days.

(21) Appl. No.: 12/756,167

(22) Filed: Apr. 7, 2010

(65) Prior Publication Data

US 2010/0257767 A1 Oct. 14, 2010

Related U.S. Application Data

(60) Provisional application No. 61/167,615, filed on Apr. 8, 2009.

(51) Int. Cl.
*G09F 17/00* (2006.01)

(52) U.S. Cl. ..... 40/603; 83/565

(58) Field of Classification Search ..... 40/606.01, 40/603, 604; 83/565, 745
See application file for complete search history.

(56) References Cited

U.S. PATENT DOCUMENTS

| | | | | |
|---|---|---|---|---|
| 5,044,102 | A * | 9/1991 | Finch et al. | 40/603 |
| 6,282,822 | B1 * | 9/2001 | Rinzler et al. | 40/590 |
| 6,322,657 | B1 * | 11/2001 | Pontuti et al. | 156/304.3 |
| 6,339,889 | B1 * | 1/2002 | Griesemer et al. | 40/603 |
| 7,861,448 | B2 * | 1/2011 | Povilaitis | 40/603 |

* cited by examiner

*Primary Examiner* — Joanne Silbermann
*Assistant Examiner* — Shin Kim
(74) *Attorney, Agent, or Firm* — Oakwood Law Group, LLP; Eli Weiss; Yuchien Wei

(57) ABSTRACT

A frame for attachment to a truck panel or a wall for holding a banner having a top base plate, a left side base plate, a right side base plate, and a bottom base plate. After the top of the banner is aligned and duct taped to the top base plate, the banner can be accurately cut to size by simply inserting a blade through the banner and into cutting groove on the base plates which becomes guides for the blade. No math is required. At least one yieldable member having a high coefficient of friction is coupled to each base plate and a cap plate is located on top of each base plate to lock the edges of a banner to each base plate by pressing on the yieldable members on each base plate when the banner is located on top of the yieldable members.

20 Claims, 3 Drawing Sheets

TRUCK AND WALL BANNER HOLDING FRAME

REFERENCE TO RELATED APPLICATIONS

This patent application claims the benefit of U.S. Provisional Application No. 61/167,615 filed on Apr. 8, 2009, the disclosure of which is incorporated herein in its entirety by reference.

BACKGROUND OF THE INVENTION

1. Field of the Invention

The present invention relates generally to apparatus and method for advertising products and services on a banner and, more specifically to a frame for holding a banner containing an advertisement to a panel of a truck or the wall of a building.

2. Description of Related Art

There are several types of frames or holders for mounting banners containing advertisements on support structures, such as trucks and building wall which are known in the art. More specifically, by way of example U.S. PreGrant Publication No. 2008/0024892 to Macsenti relates to an elongated housing containing a gripper roller which is used to grip and retain the edge of a banner in the housing. The housing includes tapered front and rear walls which define a chamber for the roller and which is open at its lower end. When an edge of the banner is inserted into the chamber via the lower opening, the gripper roller presses the banner edge against the rear surface of the front wall to suspend the banner from the device.

U.S. Pat. No. 7,406,788 to Uccello relates to fixed and floating rails adapted hold elongated locks having sign edges wrapped around non-rotating inserts, and tensioning means for tensioning signs locked in the rails, which tensioning means may be a series of short levering mechanisms spaced along and connectable to the floating rails.

U.S. Pat. No. 7,206,908 to Devaney relates to an upper frame mounted on a support structure, such as a truck, building, or billboard with, three adjustable frame assemblies and sheet material having an upper sheet tab inserted into the upper frame, and lower, right, and left sheet tabs inserted into the adjustable frame assemblies. The frame assemblies can be adjusted to vary the tension in the sheet material between the upper frame and the adjustable frame assemblies. The method includes the steps of inserting the upper sheet tab into the upper frame, inserting the right, left, and lower sheet tabs into the adjustable frame assemblies, and adjusting the adjustable frame assemblies so that the sheet material is pulled taut between the upper frame and the adjustable frame assemblies.

U.S. Pat. No. 7,178,281 to Johansson, et al. relates to a fabric sign having a pair of parallel support elements for attachment to a base and a fabric having two parallel edge portions for assembly on the support elements. One of the support elements has an inner wall section, an outer, flange-like wall section with a free supporting end to form a pivot, and an end wall section that connects the inner and outer wall sections. The wall sections form a clamping pocket for clamping the fabric to the frame.

U.S. Pat. No. 6,276,082 to Richards, et al. relates to frame members which form a rectangle where each frame member includes parallel engagement surfaces on ribs. An elongate retainer includes an elongate flange with an interlocking surface which can selectively interlock with any one of the engagement surfaces on the frame. The frame also has a frame rail having a rail surface. A tool having pinch rollers squeezes the rail surfaces toward one another to place the sheet material held by the retainer in tension while the interlocking surface is engaged with the appropriate engagement surface.

U.S. Pat. No. 6,233,859 to Kilpatrick, et al. relates to a frame element assembly having a base portion and a retaining leaf where the retaining leaf is pivotally mounted with respect to the base portion and is held in a pivotal arrangement by a bow spring. In use the retaining leaf can pivot between an "open" position in which display material can be inserted or removed from the display holder and a "closed" position in which display material is retained within the display holder.

U.S. Pat. No. 5,346,057 to Pynenburg relates to a holder having two longitudinal extruded panels each having a longitudinal C-shaped flange situated along one of the panel edges. One flange is inserted within the other one to form a longitudinal interlocking hinge connection. The panels are movable with respect to each other in a transverse direction about the hinge between an open and a closed position. The flanges are dimensioned in such a way that rotation of the panels with respect to one another in the transverse direction results in one of the flanges being elastically deformed during the first part of the motion, with the resulting stored elastic energy being abruptly released during the second part of the panel motion to snap open or close the holder. In the fully open position the holder forms a well defined receiving mouth for inserting or removing a poster to eliminate the problem of the poster being pinched.

U.S. Pat. No. 5,040,586 to Hillstrom relates to a frame that has a base portion which is attached to a building or surface and a spring loaded rotating cover portion which covers a channel in the base. A plurality of inner slidingly adjustable hook members and a pair of outer clip lock members positioned in the channel hold a banner in place. The banner has a plurality of mating holes or apertures along one edge and hangs from the hook and lock members in the frame device. Once the banner is positioned on the hooks, the cover portion is closed to retain the banner in place.

SUMMARY OF THE INVENTION

In an exemplary embodiment of the present invention, there is disclosed a frame for attachment to a truck or a wall for holding and displaying a banner comprising:

- a top base plate with left and right ends for attachment to a panel of a truck or a wall with screws;
- a cutting groove located in and extends along the length of the top base plate;
- a left side base plate with top and bottom ends where the top end abuts against a left end of the top base plate to form a left top corner of the frame when attached to the panel of the truck or the wall with screws;
- a cutting groove located in and extends along the length of the left side base plate wherein the cutting groove is a guide for a blade to cut the banner to fit the left side base plate;
- a right side base plate with top and bottom ends where the top end abuts against a right end of the top base plate to form a top right corner of the frame when attached to the panel of the truck or the wall with a screw;
- a cutting groove located in and extends along the length of the right side base plate wherein the cutting groove is a guide for a blade to cut the banner to fit the right side base plate;
- a bottom base plate with left and right ends where the left and right ends abutted against the bottom ends of the left and right side base plates to form left and right bottom corners of the frame when attached to the panel of the truck or the wall with screws;

a cutting groove located in and extends along the length of the bottom base plate wherein the cutting groove is a guide for a blade to cut the banner to fit the bottom base plate;

at least one yieldable member having a high coefficient of friction coupled to each base plate; and a cap plate located on top of each base plate;

wherein the cap plate on each base plate locks the edges of a banner to each base plate by pressing on the at least one yieldable member on each base plate when the banner is located on top of the yieldable members on the base plates.

In another embodiment of the present invention, there is disclosed a method for attaching a frame to a truck or a wall for holding and displaying a banner comprises:

providing a top base plate with left and right ends for attachment to a panel of a truck or a wall with screws;

locating a cutting groove in and along the length of the top base plate;

providing a left side base plate with top and bottom ends where the top end abuts against a left end of the top base plate to form a left top corner of the frame when attached to the panel of the truck or the wall with screws;

locating a cutting groove in and along the length of the left side base plate;

providing a right side base plate with top and bottom ends where the top end abuts against the right end of the top base plate to form a top right corner of the frame when attached to the panel of the truck or the wall with screws;

locating a cutting groove in and along the length of the right side base plate;

providing a bottom base plate with left and right ends where the bottom ends of the left and right base plates abut the left and right ends of the bottom base plate to form left and right bottom corners of the frame when attached to the panel of the truck or the wall with screws;

attaching at least one yieldable member having a high coefficient of friction to each of the base plates;

locating a cutting groove in and along the length of the bottom base plate;

aligning a top edge of a banner with the cutting groove in the top base plate and attaching the aligned top edge of the banner to the base plate with duct tape;

using the cutting groove in one of the side base plates as a guide for a cutting blade to cut away extra banner material along one side of the banner;

using the cutting groove in the other side base plate as a guide for the cutting blade to cut away extra banner material along the other side of the banner;

using the cutting groove in the bottom base plate as a guide for the cutting blade to cut away extra banner material along the other side of the banner;

aligning the cut side edges of the banner with the cutting grooves in the side base plates and the cut bottom edge of the banner with the cutting grove in the bottom base plate and attaching the banner to the base plates with duct tape; and locating a cap plate on top of each base plate;

wherein the cap plate on each base plate locks the edges of a banner to each base plate by pressing on the at least one yieldable member on each base plate when the banner is located on top of the yieldable members on the base members.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
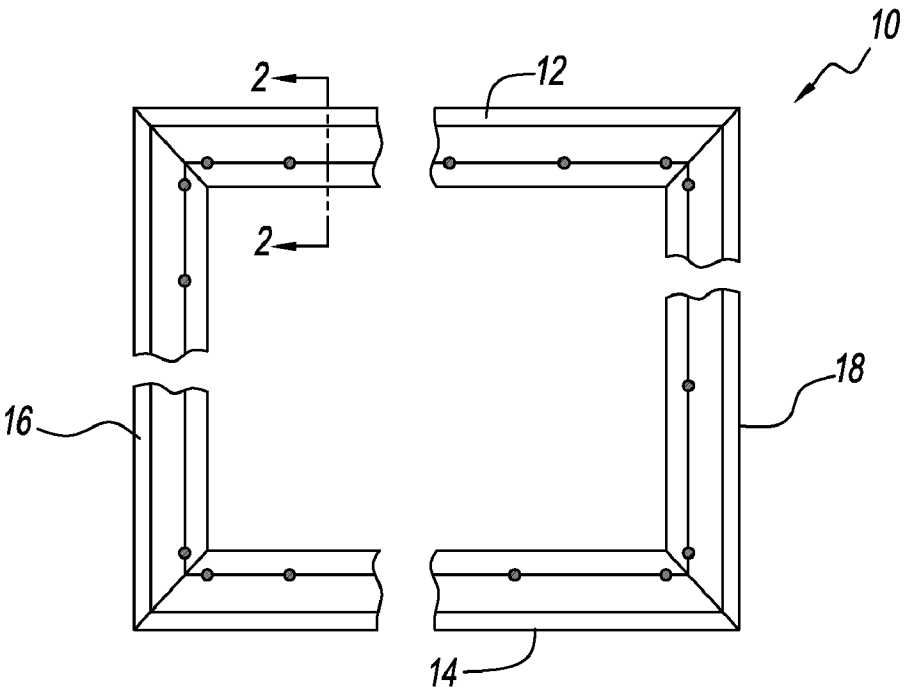
FIG. 1 is a front view of a frame for mounting on a panel of a truck or a wall of a building for holding a banner in accordance with the principles of the invention.

Referring to FIG. 1, there is disclosed a front view of the truck and wall banner holding frame which is adapted to removably hold a banner that displays an advertisement, a slogan, a saying, etc. for viewing by the public. The holding frame for the banner can be attached to a panel of a truck or to a wall of a building where the wall can be of any material such as brick, concrete, stucco, wood, etc.

Figure 2:
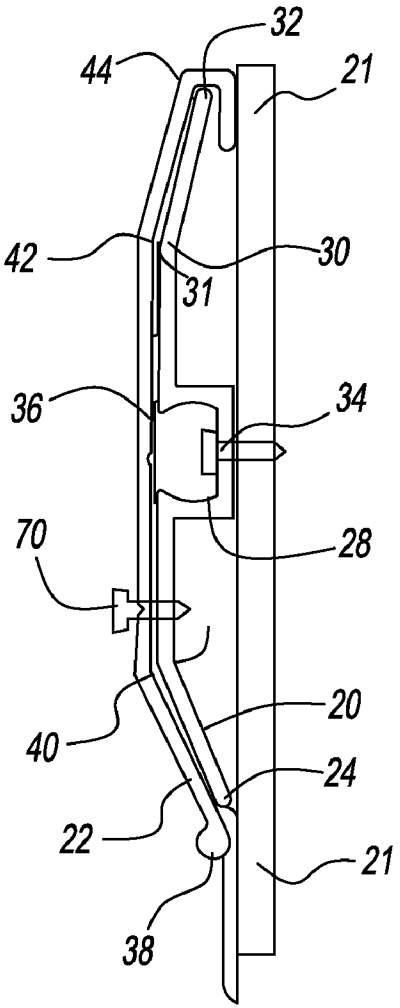
FIG. 2 is a sectional view along the line 2-2 of FIG. 1 showing a banner being held captive.
Figure 3:
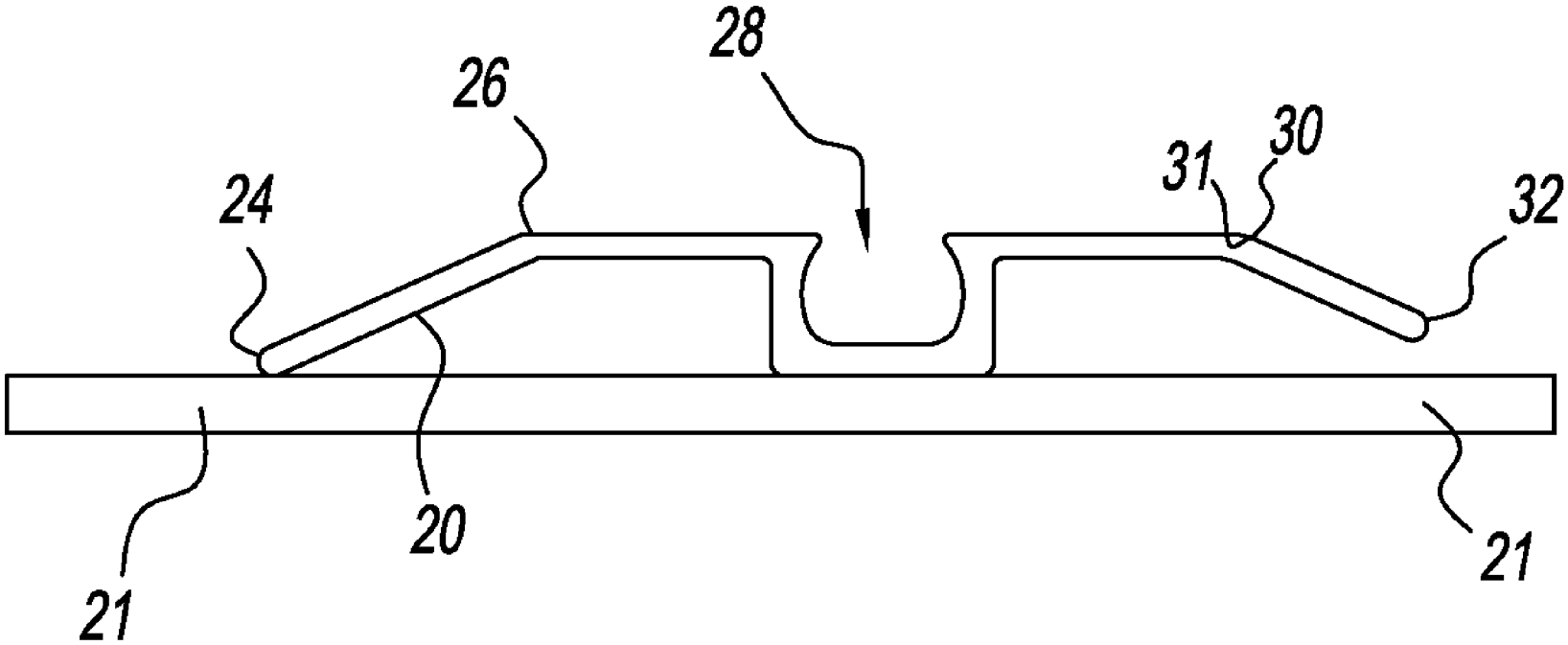
FIG. 3 is a side view of the base plate of the truck and wall banner holding frame.

Referring to FIGS. 1, 2, and 3, the frame 10 can have a pentagon, octagon, hexagon, square, rectangular, etc., shape. In the embodiment shown the frame has a rectangular shape having a top section 12, a bottom section 14, a left side section 16 and a right side section 18. Normally the top and bottom sections of the frame will have the same lengths and the left and right side sections will have the same lengths. Except for the lengths of the various sections which will depend upon the size of the banner that is to be attached to the frame, the sections are similar to each other. Therefore, in the description which follows reference will be made to the top section 12 of the frame, it being understood that the description of the top section also applies to each of the other three sections.

Each section consists of three components, a base plate 20 of plastic or extruded aluminum which is not anodized, a cap plate 22 which can be plastic or extruded aluminum and which is anodized or, and a yieldable member such as rubber which has a high coefficient of friction securing gaskets 24. The base plate 20 and cap plate 22 are made of extruded aluminum and each section is cut to size. When the frame is a square or a rectangle the ends of the abutting corner ends of the top, bottom, and side sections are mitered on an exact forty five degree angle. The extruded aluminum base plate and cap plate come in eight foot lengths. If a dimension of the frame is greater than eight feet, additional piece(s) needed to provide a frame of the desired size can be added to the frame with a butt joint.

Referring to FIG. 3, using the wall of a truck or building as the reference plane 21, the top surface of base plate 20 starts at a bottom end 24, which can touch the truck body or wall, and rises about five-sixteenths of an inch, more or less, to a first ridge 26. From the first ridge the surface extends for a distance of about five-eights of an inch parallel to the truck body or wall to a gasket trap 28 such as a channel that extends along the length of the base plate. The channel is adapted to receive a yieldable member having a high coefficient of friction such as a strip of rubber which forms a rubber gasket. From the gasket trap or channel, the top surface of the base plate extends for about five-eighths of an inch to cutting groove 31 having a depth of about one-sixteenth of an inch more of less which is located immediately below a second ridge 30, and then slopes down to a second end 32 which is spaced from the wall of the truck body or building wall a distance that is sufficient to receive a hook on the cap plate. The base plate is attached to a wall of a truck or a building wall with screws that are screwed thru the bottom of the gasket trap or channel. It is suggested that the screws be located on ten inch centers in the bottom of the gasket trap and one-half of an inch from each end. A rubber gasket 36 which can have a length of about two inches more or less is pressed into the gasket trap on top of each screw. The rubber gasket can have a cross section shape of a square, a rectangle, an oval, a circle, or any other standard or custom cross section shape.

Referring to FIG. 2, the cap plate 22 has a rounded edge 38, a first ridge engaging angle 40, a second ridge engaging angle 42, and a hook end 44 for capturing the end 32 of the base plate.

Figure 4:
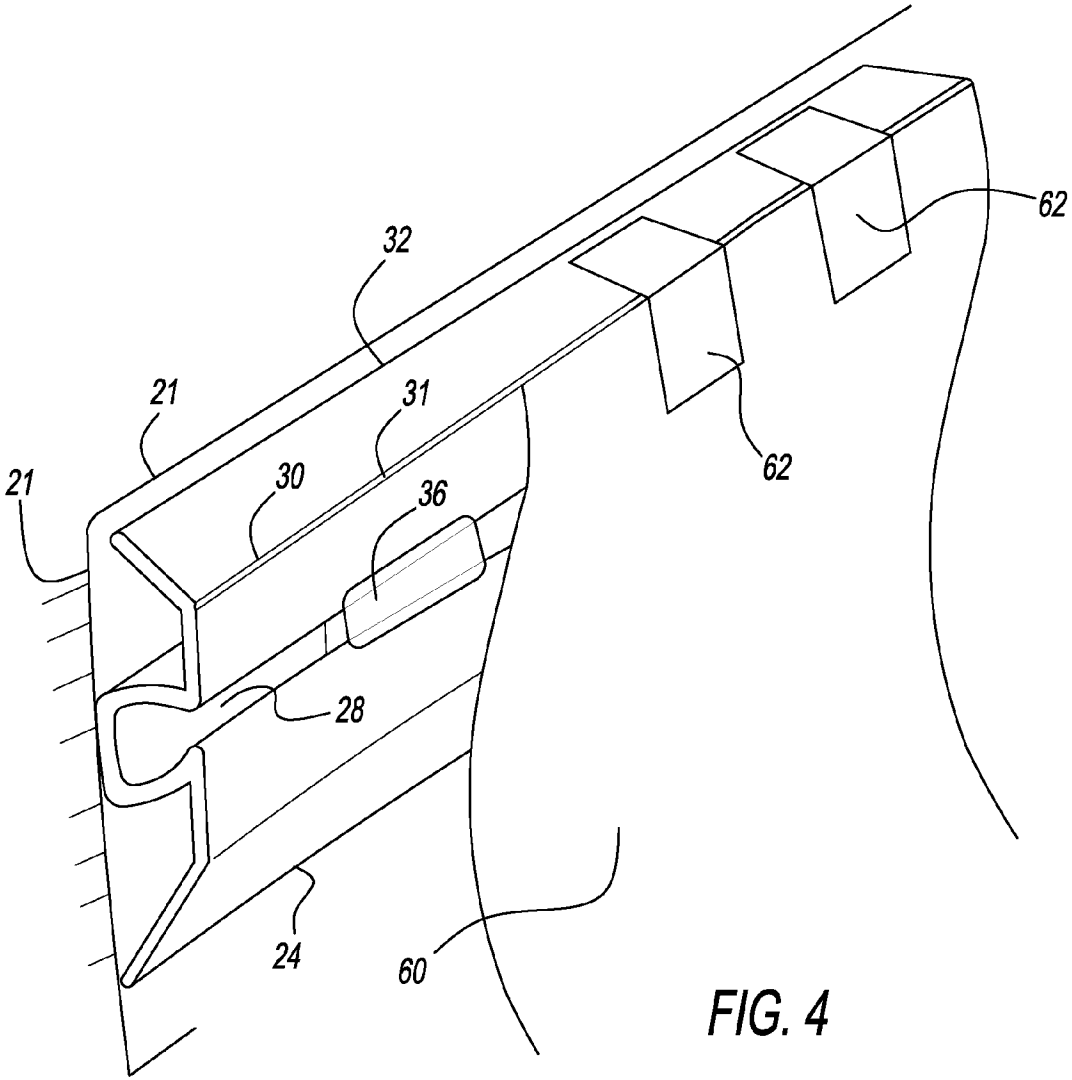
FIG. 4 is a view showing a banner being attached the base plate of the truck and wall banner holding frame.

To attach a banner 60 to the frame, and referring to FIG. 4, a pencil mark (not shown) is made at the center of the top section of the base plate 20 of the top section 12, see FIG. 1. Now the pencil center mark that was made on the tape plane ridge is lined up with the printed center mark on the banner and the banner is attached along the tape plane ridge with duct tape Pull Tabs. Prior to attaching the banner, six, 4-inch duct tape Pull Tabs are made and half of each pull-tab is attached to the banner with the other half of the pull tab sticking up ready for attachment to the base plates tape plane. Two vertical pull tabs are positioned (one on each side of the printed center mark about 1 inch away from the banner's printed center mark) creating a 2 inch space between the two center tabs. The remaining four pull tabs are spaced 2 inches apart from each other, creating three tabs on each side, and allowing for visual line-up of the printed center mark on the banner with the penciled center mark on the frame by not covering up the banner's printed center mark with a pull tab.

Now, lifting the center of the banner with its six pull tabs and aligning the printed center mark on the banner with the pencil mark on the tape plane, the top of the banner is taped along the tape plane ridge.

Note: To obtain an exact custom fit and to compensate for any positioning errors in installation, the banner is only cut across the top side. The other three sides have extra banner material that needs to be cut away a little later in the installation process. The top side is precut to allow the banner to be hung right now and to make it easy to cut the other three sides once the top side is hung.

At this time the pre-cut top part of the banner is lined up against the top sections tape plane ridge with the center pencil mark lined up with the center mark printed on the banner. The tape can go over the base plate and onto the truck body or wall; it will be cut away later. The rest of the top of the banner is now taped to the base plate as the banner is pulled slightly away from center and utilizing pull tabs spaced about 18 inches apart.

After the top of the banner is aligned and duct taped to the base plate of the top section of the frame, the two sides of the banner are then cut/trimmed to size. After the sides of the banner are cut, the bottom of the banner is then cut/trimmed to size. The two sides and bottom are cut before they are taped to the frame The banner needs to be the exact size of the base plate tape plane ridge but no math is needed, the banner is simply trimmed to the exact size by first cutting the sides of the banner along the cutting groove and then cutting the bottom of the banner with a utility knife, razor or Xact-O blade. By pulling on the banner a little, the crease which is the tape plane ridge can be seen. By inserting the blade through the banner and into the cutting groove, the groove becomes a guide for the knife's blade and the banner can be accurately cut along the groove.

Now, applying a slight downward tension to the banner, a strip of duct tape is placed at the bottom center of the banner and, after aligning the center of the banner with the center of the base plate, it is secured to the base plate of the bottom section 14.

Now, going to the left and right sides of the banner, the same procedure of attaching the center of the banner to the center of the side sections with a single strip of duct tape on each side is performed, making sure that the banner is pulled tight before the duct tape is applied.

At this time the banner is completely taped across the top and is attached to the bottom section, the left section, and right section with strips of duct tape. Now is the time to make any adjustments necessary to make the banner lay as flat and as tight as possible by adjusting the strips of duct tape. After making any adjustments, add additional strips of duct tape as needed. The banner is now as flat and as taut as is possible. Now the excess tape that is on the truck or wall is trimmed. The end of the tape away at the end up against the tape plane where the cap plate is going to hook over the base plate and hook the anodized cap plate on top of the banner and the base plate of each section is cut away. The cap plate, when screwed down onto the base plate, will further tighten the banner by increasing the distance the banner has to travel between each of the two opposing sides (top and bottom, left and right) and also lock the banner to the frame by compressing the rubber gasket under the banner.

The cap plate 22 of each section of the frame is attached to the base plate 20 of each section of the frame by placing the hook end 44 of the cap over the end 32 of the base plate and attaching the lower end of the cap to the base plate with a screw 70, see FIG. 2, which passes through a clearance opening in the cap plate and threads into an opening in the base plate. The screws 70 may be located 10 inch apart, more of less, around the entire frame.

With the cap plates attached to the base plates of each section, the banner is compressed between the cap plates and the rubber gaskets on the base plates and is locked in position to the frame, and the banner cannot slip out of the frame.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A frame for attachment to a truck or a wall for holding and displaying a banner comprising:

a top base plate with left and right ends for attachment to a panel of a truck or a wall with screws;

a cutting groove located in and extends along the length of the top base plate;

a left side base plate with top and bottom ends where the top end abuts against a left end of the top base plate to form a left top corner of the frame when attached to the panel of the truck or the wall with screws;

a cutting groove located in and extends along the length of the left side base plate wherein the cutting groove is a guide for a blade to cut the banner to fit the left side base plate;

a right side base plate with top and bottom ends where the top end abuts against a right end of the top base plate to form a top right corner of the frame when attached to the panel of the truck or the wall with a screw;

a cutting groove located in and extends along the length of the right side base plate wherein the cutting groove is a guide for a blade to cut the banner to fit the right side base plate;

a bottom base plate with left and right ends where the left and right ends abutted against the bottom ends of the left and right side base plates to form left and right bottom corners of the frame when attached to the panel of the truck or the wall with screws;

a cutting groove located in and extends along the length of the bottom base plate wherein the cutting groove is a guide for a blade to cut the banner to fit the bottom base plate;

at least one yieldable member having a high coefficient of friction coupled to each base plate; and a cap plate located on top of each base plate;

wherein the cap plate on each base plate locks the edges of a banner to each base plate by pressing on the at least one yieldable member on each base plate when the banner is located on top of the yieldable members on the base plates.

2. The frame of claim 1 wherein each base plate has a gasket trap which extends along the base plate from one end to the other end for receiving the screws for holding the base plate to the panel of a truck or a wall and for removably holding the at least one yieldable member above a screw.

3. The frame of claim 2 wherein the at least one yieldable member is made of a material having a high coefficient of friction such as rubber.

4. The frame of claim 3 wherein the rear surface of the gasket trap which extends along each base plate, when attached to the panel of the truck or the wall, contacts the panel of the truck or the wall and the edge of the base plate that is on the outside edge of the frame is spaced away from the panel of the truck or the wall.

5. The frame of claim 4 wherein the outside edge of the base plate is spaced away from the panel of the truck or the wall by a distance that is greater than the thickness of the cap plate.

6. The frame of claim 5 wherein an edge of the cap plate is formed to have a hook which fits around the outside edge of the base plate spaced from the panel of the truck or the wall.

7. The frame of claim 6 wherein the cap is attached to the base plate with a screw.

8. The frame of claim 7 wherein the gasket trap of each base plate is centrally located between the side edges of the base plate.

9. The frame of claim 8 wherein the cutting groove is located between the gasket trap and an outside edge of the frame.

10. The frame of claim 9 wherein the base plate and the cap plate are of extruded aluminum or a plastic.

11. A method for attaching a frame to a truck or a wall for holding and displaying a banner comprises:

providing a top base plate with left and right ends for attachment to a panel of a truck or a wall with screws;

locating a cutting groove in and along the length of the top base plate;

providing a left side base plate with top and bottom ends where the top end abuts against a left end of the top base plate to form a left top corner of the frame when attached to the panel of the truck or the wall with screws;

locating a cutting groove in and along the length of the left side base plate;

providing a right side base plate with top and bottom ends where the top end abuts against the right end of the top base plate to form a top right corner of the frame when attached to the panel of the truck or the wall with screws;

locating a cutting groove in and along the length of the right side base plate;

providing a bottom base plate with left and right ends where the bottom ends of the left and right base plates abut the left and right ends of the bottom base plate to form left and right bottom corners of the frame when attached to the panel of the truck or the wall with screws;

attaching at least one yieldable member having a high coefficient of friction to each of the base plates;

locating a cutting groove in and along the length of the bottom base plate;

aligning a top edge of a banner with the cutting groove in the top base plate and attaching the aligned top edge of the banner to the base plate with duct tape;

using the cutting groove in one of the side base plates as a guide for a cutting blade to cut away extra banner material along one side of the banner;

using the cutting groove in the other side base plate as a guide for the cutting blade to cut away extra banner material along the other side of the banner;

using the cutting groove in the bottom base plate as a guide for the cutting blade to cut away extra banner material along the other side of the banner;

aligning the cut side edges of the banner with the cutting grooves in the side base plates and the cut bottom edge of the banner with the cutting grove in the bottom base plate and attaching the banner to the base plates with duct tape; and locating a cap plate on top of each base plate;

wherein the cap plate on each base plate locks the edges of a banner to each base plate by pressing on the at least one yieldable member on each base plate when the banner is located on top of the yieldable members on the base members.

12. The method of claim 11 wherein each base plate has a gasket trap which extends along the base plate from one end to the other end for receiving the screw for holding the base plate to the panel of a truck or a wall and for removably holding the at least one yieldable member above a screw.

13. The method of claim 12 wherein the at least one yieldable member is made of a material having a high coefficient of friction such as rubber.

14. The method of claim 13 wherein the rear surface of the gasket trap which extends along each base plate, when attached to the panel of the truck or the wall, contacts the panel of the truck or the wall and the edge of the base plate that is on the outside edge of the frame is spaced away from the panel of the truck or the wall.

15. The method of claim 14 wherein the outside edge of the base plate is spaced away from the panel of the truck or the wall by a distance that is greater than the thickness of the cap plate.

16. The method of claim 15 wherein an edge of the cap plate is formed to have a hook which fits around the outside edge of the base plate spaced from the panel of the truck or the wall.

17. The method of claim 16 wherein the cap is attached to the base plate with a screw.

18. The method of claim 17 wherein the gasket trap of each base plate is centrally located between the side edges of the base plate.

19. The method of claim 18 wherein the cutting groove is located between the gasket trap and an outside edge of the frame.

20. The method of claim 19 wherein the base plate and the cap plate are of extruded aluminum or a plastic.

* * * * *